United States Patent [19]

Rogers et al.

[11] Patent Number: 4,754,928

[45] Date of Patent: Jul. 5, 1988

[54] VARIABLE MASSAGE SHOWERHEAD

[75] Inventors: Daniel G. Rogers, Homer; Scott T. Christy; Harold H. Leutheuser, both of Hillsdale, all of Mich.

[73] Assignee: Alsons Corporation, Hillsdale, Mich.

[21] Appl. No.: 3,151

[22] Filed: Jan. 14, 1987

[51] Int. Cl.[4] ..... B05B 3/04; B05B 3/16

[52] U.S. Cl. ..... 239/381; 239/447; 239/449

[58] Field of Search ..... 239/380–383, 239/443, 444, 446–449, 563

[56] References Cited

U.S. PATENT DOCUMENTS

| | | | |
|---|---|---|---|
| 3,568,716 | 3/1971 | Heitzman | 137/624.14 |
| 3,713,587 | 1/1973 | Carson | 239/447 |
| 3,722,799 | 3/1973 | Rauh | 239/443 |
| 3,762,648 | 10/1973 | Deines et al. | 239/383 |
| 3,801,019 | 4/1974 | Trenary et al. | 239/383 |
| 3,876,151 | 4/1975 | Katva | 239/437 |
| 3,893,628 | 7/1975 | McCollum | 239/521 |
| 3,940,069 | 2/1976 | Gunzel et al. | 239/318 |
| 3,958,756 | 5/1976 | Trenary et al. | 239/102 |
| 3,963,179 | 6/1976 | Tomaro | 239/101 |
| 4,068,801 | 1/1978 | Leutheuser | 239/383 |
| 4,145,004 | 3/1979 | Krizik | 239/563 |
| 4,187,986 | 2/1980 | Petrovic | 239/449 |
| 4,203,550 | 5/1980 | On | 239/383 |
| 4,324,364 | 4/1982 | Buzzi et al. | 239/381 |
| 4,398,669 | 8/1983 | Fienhold | 239/447 |

FOREIGN PATENT DOCUMENTS

| | | | |
|---|---|---|---|
| 193138 | 9/1986 | European Pat. Off. | 239/446 |

*Primary Examiner*—Andres Kashnikow
*Assistant Examiner*—Karen B. Merritt
*Attorney, Agent, or Firm*—Lyon & Lyon

[57] ABSTRACT

A showerhead including an inlet end and an outlet end. The inlet end of the showerhead body forms a spiral chamber which produces a rotating current of water. An inner disc having a series of ports therethrough is positioned immediately adjacent to an outer disc which also has a series of ports therethrough. A spinner, on the inlet end of the inner disc, rotatably driven by the rotating current of water, has open and closed portions which pass in sequence across certain of inner disc ports producing a pulsating water stream therethrough. The outer disc is rotationally adjustable relative to the inner disc. The ports of both discs are arranged in concentric rings such that as the outer disc is rotated relative to the inner disc, varying throughpaths are achieved as the outer disc ports align with the inner disc ports. Four spray modes are achieved: (1) a variable regular spray, (2) combination pulsating and regular spray, (3) variable pulsating spray, and (4) variable pulsating misting spray.

19 Claims, 3 Drawing Sheets

FIG. 3.
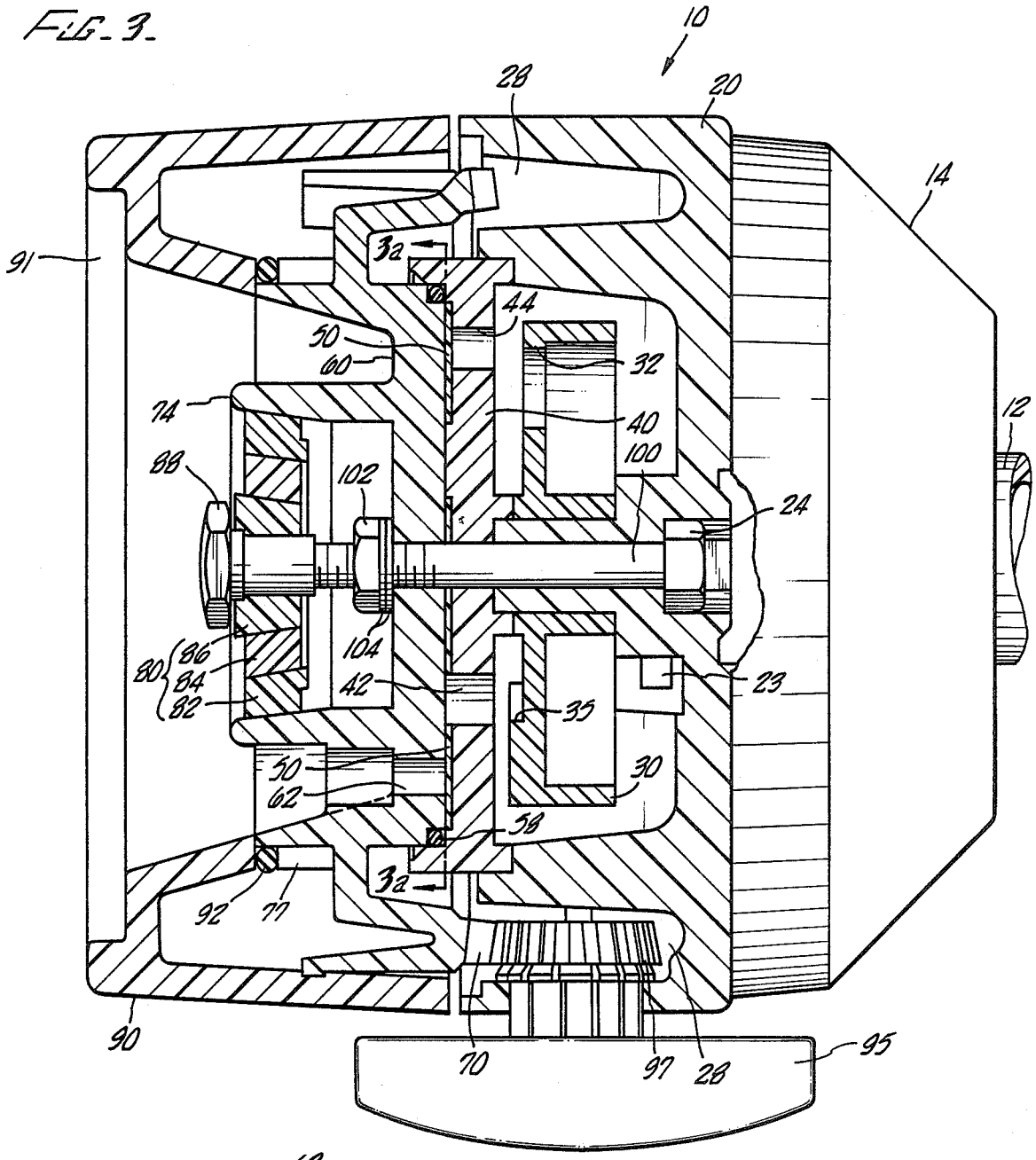
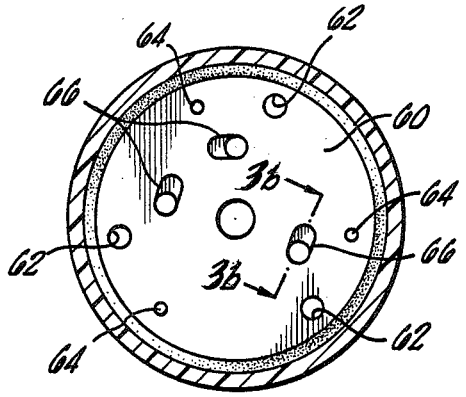
FIG. 3a.
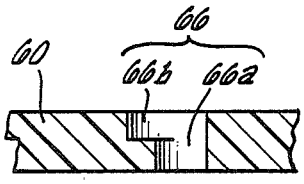
FIG. 3b.

VARIABLE MASSAGE SHOWERHEAD

BACKGROUND OF THE INVENTION

The field of the present invention is a pulsating or massage type showerhead for the shower or bath. Various types of showerheads have been provided for showers which have produced a pulsating spray, for example the showerheads shown in the following U.S. Pat. Nos.: 3,876,151, 3,893,628, 3,801,019, and 4,068,801. Some of the identified patents merely produce only the pulsating spray, others may be adjusted to provide a steady or a pulsating spray, or a combination thereof. Some showerheads have a complicated adjustment mechanism. In certain showerheads the selection of the desired spray type is difficult under the conditions of use because of low water pressure or the mandated use of flow restrictors (maximum 3 gpm) encountered in some areas of the U.S.A.

SUMMARY OF THE INVENTION

The present invention is directed to an improvement in pulsating jet shower showerheads and is summarized in the following objects:

First, to provide a showerhead which is capable of four spray modes, specifically: (1) a variable conventional spray, (2) variable combination pulsating and conventional spray, (3) variable pulsating spray, and (4) variable pulsating misting spray.

Second, to provide a showerhead in which the water is caused to rotate and drive a spinner having opened and closed portions which pass in sequence across a ring of jet ports in an inner disc to cause intermittent or pulsating discharge of water therefrom. The ring of jet ports for pulsating are in a ring of one diameter while a second series of ports are arranged in a concentric ring of a different diameter, such that the opened and closed portions of the spinner only affect the flow of water through the jet ports for pulsating. Adjacent to the inner disc is a rotatable operating faceplate in outer disc which contains a series of ports arranged in concentric rings of diameters which correspond to those in the inner disc. Through the adjustable rotation of the outer disc with respect to the inner disc, the varying spray characteristics as indicated in the first object are obtained.

Third, to provide a showerhead, as indicated in the preceding objects, wherein the various modes of spray are operably changed by a side operated knob which facilitates infinite adjustment.

Fourth, to provide a showerhead with a decorative faceplate which is easily interchangeable.

BRIEF DESCRIPTION OF THE DRAWINGS

FIG. 3 is a cross section of FIG. 1 along the line 3—3.

FIG. 3*a* is a detailed side view of FIG. 3 taken along line 3*a*—3*a*.

FIG. 3*b* is a cross section of FIG. 3*a* taken along line 3*b*—3*b*.

DETAILED DESCRIPTION OF THE PREFERRED EMBODIMENT

Figure 1:
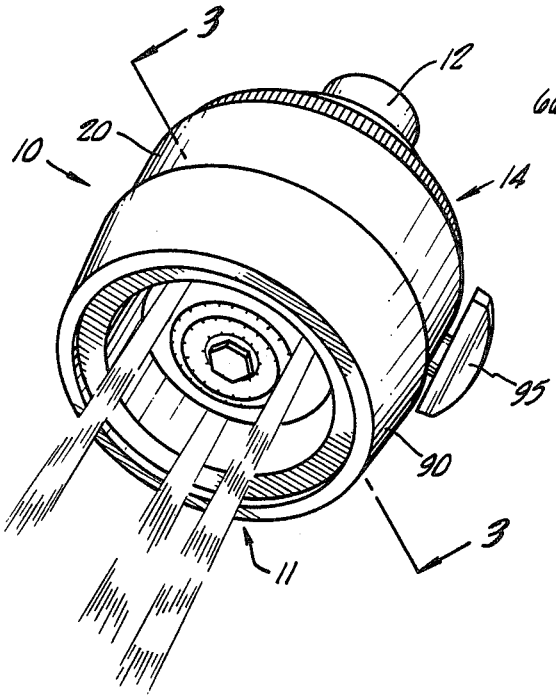
FIG. 1 is a perspective view of a fully assembled showerhead according to the present invention.

Turning in details to the drawings, FIGS. 1, 2, 3, 3*a* and 3*b* illustrate the preferred embodiment according to the present invention. Any component having a numeral in one drawing represents the same component in any other drawing. FIG. 1 shows a showerhead 10 with an outlet end 11 and an inlet end at ball connector 12. Ball connector 12 is sealably attached to showerhead 10 by ball nut 14. Side operated knob 95 operably rotates (through a mechanism to be described later) the outlet end 11, which includes a removable decorative faceplate 90, relative to the inlet end which includes showerhead body 20, ball nut 14 and ball connector 12.

Further details of showerhead 10 will now be described with particular reference to FIGS. 2 and 3. The parts of shower head 10 from operating faceplate an outer disc 60 to shower head body 20 are secured by a center hex bolt 100 which passes through center shaft 24 of shower head body 20, through spinner 30, inner disc 40, mode wafer 50, O-ring 58, and the center of outer disc 60 where it is secured by a nut 102. Two nylon washers 104 are placed on hex bolt 100 between nut 102 and outer disc 60 to facilitate free rotation of outer disc 60 relative to nut 102.

Water enters the showerhead 10 through ball connector 12 which is sealably attached to showerhead body 20 by O-ring 16 positioned between ball connector 12 and a body seat (not shown). Ball nut 14 is threaded and screwed onto a threaded end of showerhead body 20. As the water enters showerhead 10 through ball connector 12, a means is provided in showerhead body 20 for producing a rotating current of water within the showerhead body 20. Such a means may be a spiral entry in showerhead body 20 as partially shown in FIG. 3 by spiral outlet 23. The rotating water drives a spinner having opened portions 32 and raised closed portion 35. The underside of the spinner 30 may have a series of ribs or vanes (not shown), which when viewed from the inlet side appear in a pie configuration. These vanes are impacted upon by the rotating current of water causing spinner 30 to rotate about center shaft 24 of showerhead body 20. Both the opened portions 32 and the closed portion 35 are arranged in a ring about the center of spinner 30. As the rotating water drives spinner 30, the opened and closed portions 32, 35 pass in sequence across a series of outer jet ports 44 on the inner disc 40 to cause intermittent or pulsating discharge therefrom. The spinner 30 and the means for providing the rotating current are further described in U.S. Pat. No. 4,068,801 which is herewith incorporated by reference for all purposes. The series of outer jet ports 44 on the inner disc 40 are arranged in a ring at a diameter which corresponds to the opened and closed portions 32, 35 of spinner 30.

Inner disc 40 also has a series of inner jet ports 42 which are arranged in a ring at a diameter inside of the ring of outer jet ports 44. Water may enter inner jet ports 42 without the resulting pulsating discharge characteristic experienced by the outer jet ports 44. A series of outlet holes are arranged in rings on outer discs 60 which correspond to the inner and outer jet ports 42, 44 of inner disc 40. A thin wafer 50 made of a material such as polyethylene is sandwiched between inner disc 40 and outer disc 60. This wafer 50 serves as a sealing disc and provides lubricity for easier turning during spray adjusting. Wafer 50 has a series of inner holes 52 and outer holes 54 which correspond to the inner and outer jet ports 42, 44 on inner disc 40. Inner disc 40 has protrusions 46 which correspond to openings 56 in wafer 50 thereby holding wafer 50 in place relative to inner disc 40.

Alternately wafer 50 could have holes corresponding to the holes on outer disc 60 and be attached to outer disc 60 such that the wafer 50 would not rotate relative to outer disc 60.

Figure 2:
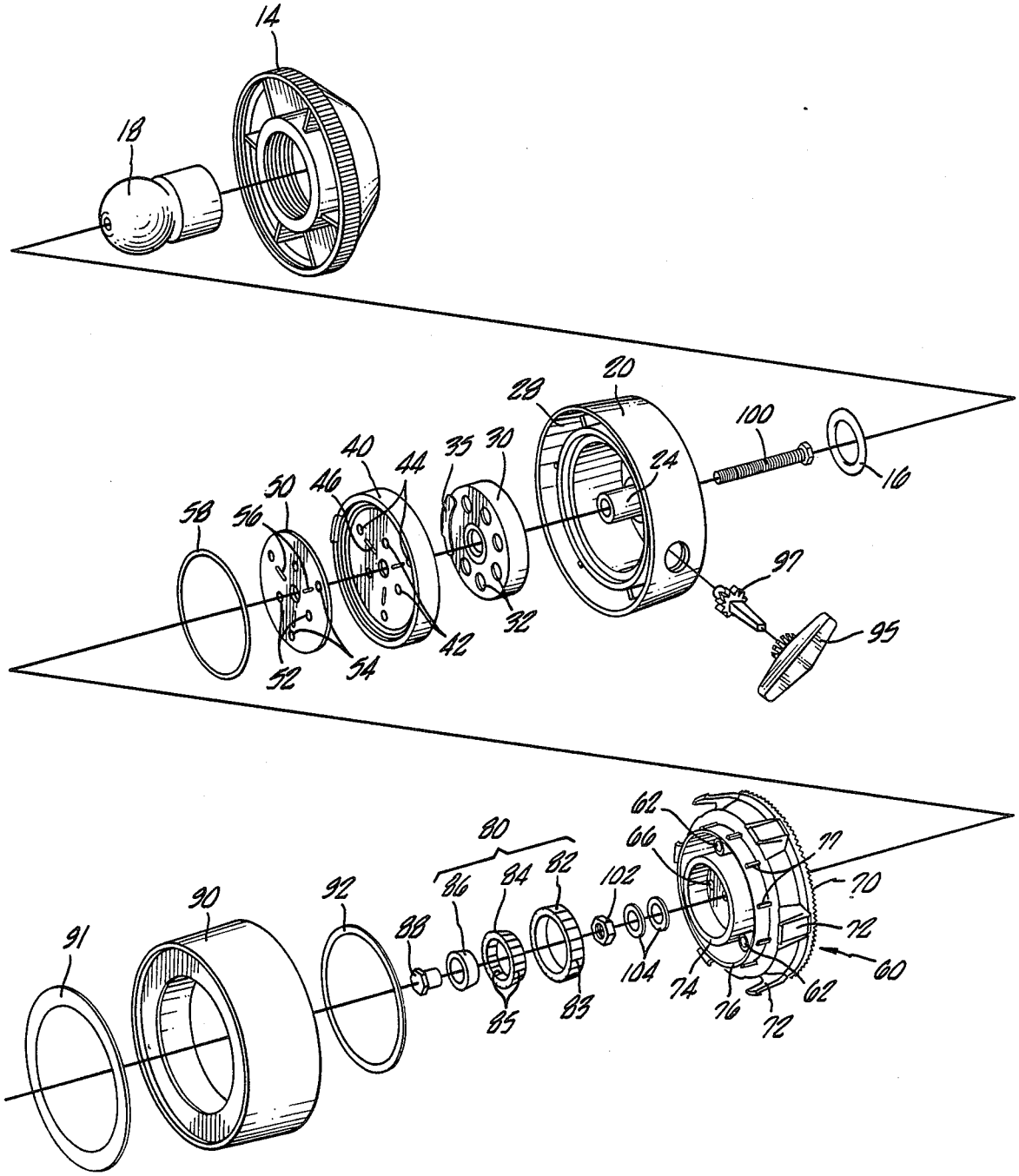
FIG. 2 is an exploded view of FIG. 1 showing an assembly of parts.

FIG. 2 shows an inner disc 40 having three outer jet ports 44, each having a diameter of about 0.12 inches, equally spaced in a ring having a diameter of about 1.44 inches. Inner disc 40 also has three inner jet ports 42 with diameters of about 0.12 inches and equally spaced in a ring having a diameter of about 0.875 inches. Inner jet ports 42 are also equally spaced between outer jet ports 44.

An O-ring 58 seats between inner disc 40 and outer disc 60 to prevent leakage of water out of the inner portion of showerhead body 20 into outer chamber 28 of showerhead body 20.

The features of outer disc 60 will now be described in detail with particular reference to FIGS. 3 and 3*a*.

The varying types of spray are accomplished by rotating the outer disc 60 relative to the inner disc 40 varying the alignment between the holes of the two discs. Outer disc 60 has a series of jet ports 62 having a diameter of about 0.12 inches equally spaced about a ring having a diameter about 1.44 inches. Jet ports 62 extend outwardly (as also viewed in FIG. 2) from outer disc 60 to direct the pulsating streams in a straight or control direction and make charge in the variable pulsating streams possible. The thickness of outer disc 60 is about 0.175 inches through which ports 62, 64 and 66 are located. Jet ports 62 extend about an additional 0.195 inches, the extensions having a diameter of about 0.19 inches. A series of fine pulse ports 64 having a diameter of about 0.067 inches equally spaced in a ring of about 1.44 inches. The fine pulse ports 64 are offset about 40 degrees behind the jet ports 62 of outer disc 60.

Along an inner ring at approximately a diameter of 0.875 inches are a series of spray ports 66 arranged in a ring having a diameter about 0.875 inches. Referring to FIGS. 3*a* and 3*b*, adjustable spray ports 66 are comprised of two adjacent holes each having a diameter of about 0.155 inches. One of the holes of adjustable spray port 66, hole 66*a*, extends all the way through outer disc 60, while its adjoining step hole 66*b* only extends about halfway (about 0.09 inches) through outer disc 60. As spray port 66 in outer disc 60 lines up with inner jet ports 42 of inner disc 40, finer adjustment of spray is achieved by the step port shape of spray port 66 *a/b*. Spray port holes 66 *a* & *b* have centers on a ring having the diameter of about 0.875 inches. Adjustable spray port 66 has holes 66*a* and 66*b* having centers offset by about 11°45′ and a circumferential dimension of about 0.245 inches (the width as shown in FIG. 3*b*).

The location of the adjustable spray ports 66 relative to fine pulse ports 64 and pulsating ports 62 will now be described with reference to FIG. 3*a*. One port 66 has a through hole 66*a* located at an angle of 0° shown in FIG. 3*a* to be top vertical. The step hole 66*b* is then located to the left (counterclockwise) with its center at an angle of about −11°45′. A pulsating port 62 is located with its center at about +20°. The other pulsating ports 62 being equally spaced are then located at 140° and 260°. A fine pulse port 64 is located with its center at about −20° and since the fine pulse ports 64 are equally spaced, the other two are located at 100° and 220°. A second adjustable spray port 66 is positioned with its through hole 66*a* at about 120° with its step hole 66*b* offset in a counterclockwise or negative direction as viewed in FIG. 3*a*. The third adjustable spray hole 66 is located with its through hole 66*a* located at 280° with its step hole 66*b* oriented clockwise.

The face of outer disc 60 must be smooth against wafer 50 so that though the surfaces are in contact to minimize or prevent leakage when the ports are not aligned, the two surfaces may slide freely.

Side operated knob 95 snap fits into a hole in showerhead body 20 attaching to pinion gear 97. Pinion gear 97 has a gear which meshes with the gears 70 along the underside of outer disc 60. This gearing permits 360° rotation and fine adjustment. The gears 70 and pinion gear 97 operate in the dry chamber 28 between side walls of showerhead body 20 thereby minimizing possibility of leaks.

The relative alignment of the ports 62, 64, 66, outer disc 60 relative to the ports 42, 44 of inner disc 40 determines the type of spray achieved. FIGS. 4*a* through 4*d* schematically illustrate various spray modes achieved by the disclosed configuration. The views in all the figures are shown from the inlet side. The component numerals used in FIGS. 4*a–d* correspond to the same components numerals identified in the other drawings. A prime (′) added to a numeral identifies that hole or port as being aligned relative between the outer disc 60 and the inner disc 40 and would allow water to pass therethrough. The aligned hole or port is further identified by appearing darkened or shaded.

Figure 4A:
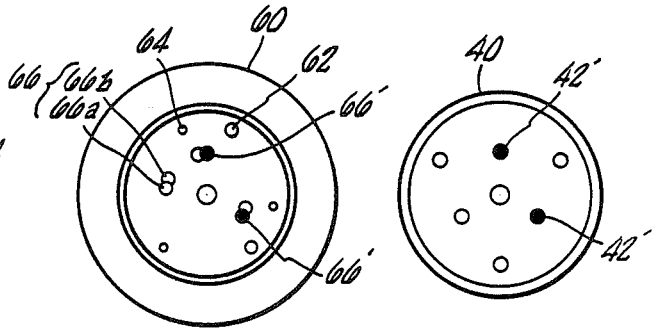
FIG. 4*a* illustrates the relative alignment between the inner disc and the outer disc producing the full spray pattern.

FIG. 4*a* shows alignment of two adjustable spray ports 66 and outer disc 60 with two inner jet ports 42 of inner disc 40. Water may pass through these pairs of holes in a constant, full spray pattern i.e., a conventional spray as it passes through the spray disc assembly 80.

Figure 4B:
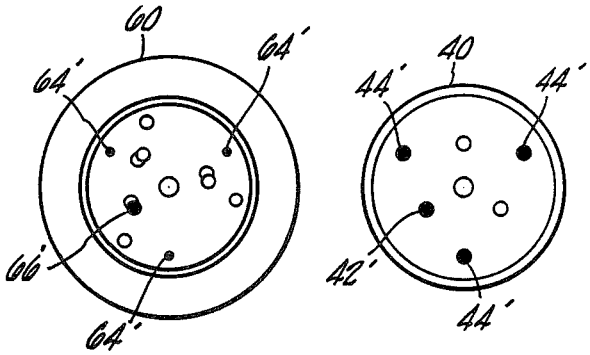
FIG. 4*b* illustrates the relative alignment between the inner disc and the outer disc producing a combination full spray and pulsating pattern.

FIG. 4*b* illustrates an alignment which results in a combination of full spray and massage or pulsating action. All three fine pulse ports 64′ are aligned with the outer jet ports 44′. Water passing through the fine pulse ports 64′ creates a pulsating water action. Simultaneously, a constant flow of water passes through one inner disc jet port 42′ and one outer spray disc port 66′ providing a full spray pattern. Finer adjusting of the control will achieve the desired spraying-pulsating spray mixture.

Figure 4C:
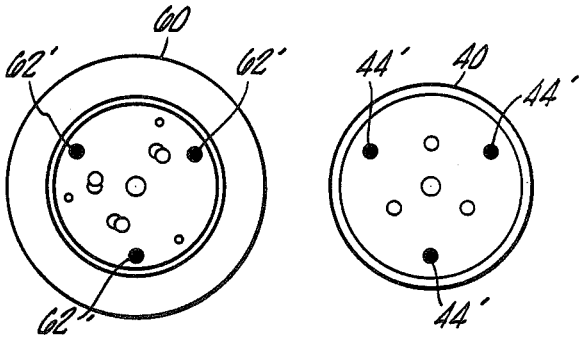
FIG. 4*c* illustrates the relative alignment between the inner disc and the outer disc producing a full pulsating pattern.

FIG. 4*c* illustrates an orientation which provides pulsating water jets. Outer jet ports 62′ align directly with inner jet ports 44′ creating the pulsating effect.

Figure 4D:
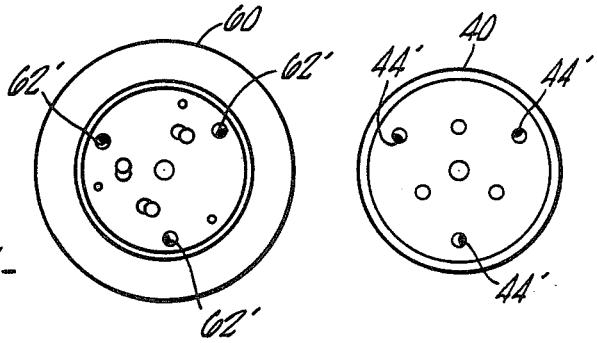
FIG. 4*d* illustrates the relative alignment between the inner disc and the outer disc producing a misting spray.

FIG. 4*d* illustrates a variable pulsating misting spray. By positioning jet ports 62′ to align slightly offset with outer jet ports 44′, a pulsating, misting spray is obtained.

Water passing through spray jets 66 are diffusedly exited through spray disc assembly 80 which is comprised of spray discs 82, 84 and 86. Spray discs 82, 84 and 86 are tapered and adapted to fit concentrically. The spray disc wall 74 is also tapered with approximately an 8° taper to accommodate the tapered spray disc assembly 80. The periphery of the spray discs is provided with rings of axially extending grooves 83, 85. FIG. 2 shows the center spray disc 84 having axial grooves 85 on both its inner periphery and its outer periphery. Outer spray disc 82 has axial grooves 83 on its outer periphery. Each of the axial grooves 83, 85 abuts a smooth confronting wall so that the grooves 83, 85 form a concentric ring of spray nozzles. Spray disc assembly 80 is secured within the tapered spray disc wall 74 by cap nut 88 secured on hex bolt 100.

A removable decorative faceplate 90 snap fits to the outer disc 60 by means of the series of outer clips 72 on the outer disc 60. An O-ring 92 sits on wall support 77 around jet wall 76 to cushion and seal between the inner wall of removable decorative faceplate 90 and jet wall 76. The snap fit feature of the decorative faceplate facilitates assembly. In addition, the entire shower head may be changed to a different model with a faceplate of different configuration. This feature also permits a decorative color change in the faceplate 90 such as chrome, polish brass, and antique brass, etc.

The removable decorative faceplate 90 may also be adapted to accommodate a faceplate label 91. The faceplate label 91 may be decorated with designs, company logos, or other personalized information.

Though the embodiment illustrated and described is a wall model, a hand held model is also envisioned to be within the scope of the present invention.

Thus, a showerhead is disclosed which has four spray modes operable by a side operated knob allowing 360 degree rotation and infinite adjustment. While embodiments and applications of this invention have been shown and described, it would be apparent to those skilled in the art that many more modifications are possible without departing from the inventive concepts herein. The invention, therefore, is not to be restricted except in the spirit of the appended claims.

What we claim is:

1. A showerhead comprising:

a body having an outlet end and an inlet end, said inlet end having means for producing a rotating water current as water enters said body;

an inner disc having ports therethrough, said inner disc ports arranged in concentric rings;

an outer disc adjacent to said inner disc on the outlet end thereof, said outer disc having a series of ports therethrough, said outer disc ports arranged in concentric rings; and a spinner disposed adjacent the inlet end of said inner disc and driven by the rotating water current, said spinner having open and closed portions which pass in sequence across certain of said ports in said inner disc thereby producing a pulsating effect;

wherein said inner disc comprises a series of inner ports arranged in a ring at a first diameter and a set of outer ports arranged in a ring at a second diameter greater than said first diameter;

wherein said outer disc comprises a set of spray ports arranged in a ring at said first diameter, a set of jet ports arranged in a ring at said second diameter, and a set of fine pulse ports arranged in a ring at said second diameter; and wherein said outer disc is rotationally adjustable relative to said inner disc such that varying throughpaths for water are achieved as said outer disc ports align with said inner disc ports.

2. A showerhead according to claim 1 wherein said inner disc has three inner ports equally spaced about said first diameter and three outer ports equally spaced about said second diameter from each other and from said inner ports, and wherein said spray ports, said jet ports, and said fine pulse ports in said outer disc are spaced to allow alternately as said outer disc is rotated relative to said inner disc:

(1) alignment of at least one spray port on said outer disc with an inner port on said inner disc, (2) alignment of at least one spray port on said outer disc with an inner port on said inner disc and alignment of a plurality of said fine pulse ports on said outer disc with said outer ports on said inner disc, (3) alignment of a plurality of said jet ports on said outer disc with outer ports on said inner disc, and (4) partial alignment between a plurality of said jet ports of said outer disc with the outer ports on said inner disc.

3. A showerhead according to claim 1 wherein said jet ports in said outer disc have elongated exits extending outwardly to direct a water stream in a controlled direction.

4. A showerhead according to claim 1 wherein each of said spray ports comprises:

a through hole portion, and a stepped portion positioned adjacent the through hole portion, wherein said stepped portion only extends part way through said outer disc from said inlet end.

5. A showerhead comprising:

a body having an outlet end and an inlet end, said inlet end having means for producing a rotating water current as water enters said body;

an inner disc having ports therethrough, said inner disc ports arranged in concentric rings;

a spinner disposed adjacent the inlet end of said inner disc and driven by the rotating water current, said spinner having open and closed portions which pass in sequence across certain of said ports in said inner disc thereby producing a pulsating effect;

an outer disc adjacent to said inner disc on the outlet end thereof, said outer disc having a series of ports therethrough, said outer disc ports arranged in concentric rings, wherein said outer disc is rotationally adjustable relative to said inner disc such that varying throughpaths for water are achieved as said outer disc ports align with said inner disc ports;

a ring gear on said outer disc concentric with said concentric rings and encompassing said outer disc ports;

a sealing means positioned between said inner disc and said outer disc and radially between said ring gear and said outer disc ports to prevent leakage of water out from said ports toward said ring gear;

a pinion gear meshing with said ring gear; and a side operated knob for turning said pinion gear.

6. A showerhead according to claim 5 further comprising:

an outer shell and a dry chamber between said outer shell and said sealing means wherein said ring gear and said pinion gear operate in said dry chamber.

7. A showerhead according to claim 5 wherein said sealing means comprises an O-ring positioned between adjacent faces of said outer disc and said inner disc and circumferentially between said outer disc ports and said ring gear.

8. A showerhead comprising:

a body having an outlet end and an inlet end;

an inner disc having ports therethrough, said inner disc ports arranged in concentric rings;

an outer disc adjacent to said inner disc on the outlet end thereof, said outer disc having a series of ports therethrough, said outer disc ports arranged in concentric rings, wherein said outer disc is rotationally adjustable relative to said inner disc such that the varying throughpaths for water are achieved as said outer disc ports align with said inner disc ports;

a ring gear on said outer disc concentric with said concentric ring and encompassing said outer disc ports;

a sealing means positioned between said inner disc and said outer disc and radially between said ring gear and said outer disc ports to prevent leakage of water out from said ports toward said ring gear;

a pinion gear meshing with said ring gear; and a side operated knob for turning said pinion gear.

9. A showerhead according to claim 8 further comprising:

a wafer between said outer disc and said inner disc.

10. A showerhead according to claim 9 wherein said inlet end has means for producing a rotating water current as water enters said body, said showerhead further comprising:

a spinner disposed adjacent the inlet end of said inner disc and driven by the rotating water current, said spinner having open and closed portions which pass in sequence across certain of said ports in said inner disc thereby producing a pulsating effect.

11. A showerhead according to claim 9 wherein said wafer is held to said inner disc, remaining in position therewith as said outer disc rotates, and has holes therethrough which align with and correspond to the inner disc ports.

12. A showerhead according to claim 9 wherein said wafer is held to said outer disc, rotating therewith, and has holes therethrough which align with a correspond to the outer disc ports.

13. A showerhead according to claim 9 wherein said wafer is constructed out of polyethylene.

14. A showerhead according to claim 8 further comprising a removable faceplace detachably connected to said outer disc.

15. A showerhead comprising:

a body having an outlet end and an inlet end, said inlet end having means for producing a rotating water current as water enters said body;

an inner disc having ports therethrough, said inner disc ports arranged in concentric rings;

a spinner disposed adjacent the inlet end of said inner disc and driven by the rotating water current, said spinner having open and closed portions which pass in sequence across certain of said ports in said inner disc thereby producing a pulsating effect; and an outer disc adjacent to said inner disc on the outlet end thereof, said outer disc having a series of ports therethrough, said outer disc ports arranged in concentric rings, wherein said inner disc comprises a series of inner ports arranged in a ring at a first diameter and a set of outer ports arranged in a ring at a second diameter greater than said first diameter, wherein said outer disc comprises a set of spray ports arranged in a ring at said first diameter and a set of jet ports arranged in a ring at said second diameter, wherein said outer disc is rotationally adjustable relative to said inner disc such that varying throughpaths for water are achieved as said outer disc ports align with said inner disc ports, and wherein said jet ports in said outer disc have elongated exits extending outwardly to direct a water stream in a controlled direction.

16. A showerhead comprising:

a body having an outlet end and an inlet end, said inlet end having means for producing a rotating water current as water enters said body;

an inner disc having ports therethrough, said inner disc ports arranged in concentric rings;

a spinner disposed adjacent the inlet end of said inner disc and driven by the rotating water current, said spinner having open and closed portions which pass in sequence across certain of said ports in said inner disc thereby producing a pulsating effect; and an outer disc adjacent to said inner disc on the outlet end thereof, said outer disc having a series of ports therethrough, said outer disc ports arranged in concentric rings, wherein said inner disc comprises a series of inner ports arranged in a ring at a first diameter and a set of outer ports arranged in a ring at a second diameter greater than said first diameter, wherein said outer disc comprises a set of spray ports arranged in a ring at said first diameter and a set of jet ports arranged in a ring at said second diameter, wherein said outer disc is rotationally adjustable relative to said inner disc such that varying throughpaths for water are achieved as said outer disc ports align with said inner disc ports, and wherein each of said spray ports comprises:

a through hole portion and a stepped portion positioned adjacent the through hole portion, wherein said stepped portion only extends part way through said outer disc from said inlet end.

17. A showerhead comprising:

a body having an outlet end and an inlet end;

an inner disc having ports therethrough, said inner disc ports arranged in at least one concentric ring; and an outer disc adjacent to said inner disc on the outlet end thereof, said outer disc having a series of ports therethrough, said outer disc ports arranged in at least one concentric ring;

wherein said inner disc comprises a first series of ports arranged in a ring at a first diameter, wherein said outer disc comprises a first set of ports arranged in a ring at said first diameter and a second set of ports arranged in a ring at said first diameter, and wherein said outer disc is rotationally adjustable relative to said inner disc such that varying throughpaths for water are achieved as said outer disc ports align with said inner disc ports.

18. A showerhead according to claim 17 wherein said inner disc comprises a second series of ports arranged in a ring at a second diameter, said second diameter being different than said first diameter; and wherein said outer disc comprises a third set of ports arranged in a ring at said second diameter.

19. A showerhead according to claim 18 wherein said inner disc has three ports in said first series of ports equally spaced about said first diameter and three ports in said second series of ports equally spaced about said second diameter from each other and from said first series of ports, and wherein said first, second and third set of ports in said outer disc are spaced to allow alternatively as said outer disc is rotated relative to said inner disc:

(1) alignment of at least one port of the first set of ports on said outer disc with a port of the first series of ports on said inner disc, (2) alignment of at least one port of the second set of ports on said outer disc with a port of the first series of ports on said inner disc, and (3) alignment of at least one port of the third set of ports on said outer disc with a port of the second series of ports in said inner disc.

* * * * *